US010888978B2

(12) United States Patent
Albertson

(10) Patent No.: US 10,888,978 B2
(45) Date of Patent: Jan. 12, 2021

(54) SOCKET WRENCH

(71) Applicant: Robert V. Albertson, Mound, MN (US)

(72) Inventor: Robert V. Albertson, Mound, MN (US)

(73) Assignee: Albertson Enterprises, LLC, Mound, MN (US)

( * ) Notice: Subject to any disclaimer, the term of this patent is extended or adjusted under 35 U.S.C. 154(b) by 238 days.

(21) Appl. No.: 16/127,555

(22) Filed: Sep. 11, 2018

(65) Prior Publication Data

US 2019/0076995 A1 Mar. 14, 2019

Related U.S. Application Data

(60) Provisional application No. 62/557,474, filed on Sep. 12, 2017.

(51) Int. Cl.

| | |
|---|---|
| ***B25B 13/46*** | (2006.01) |
| ***B25B 23/00*** | (2006.01) |
| ***B25B 13/48*** | (2006.01) |

(52) U.S. Cl.

CPC ..... *B25B 13/462* (2013.01); *B25B 13/481* (2013.01); *B25B 23/0035* (2013.01); *B25B 23/0057* (2013.01)

(58) Field of Classification Search

CPC ... B25B 13/462; B25B 13/463; B25B 13/465; B25B 13/466; B25B 13/467; B25B 13/481; B25B 13/485; B25B 23/0035; B25B 23/0057; B25B 15/04; B25B 13/5066; B25B 13/461; B25B 13/46; B25B 13/48; B25B 23/00; B25B 13/12; B25B 13/06

See application file for complete search history.

(56) References Cited

U.S. PATENT DOCUMENTS

| | | | |
|---|---|---|---|
| 1,511,226 | A | 10/1924 | Lawrence |
| 2,529,476 | A | 11/1950 | Albertson |
| 2,529,947 | A | 11/1950 | Johnson |
| 3,208,318 | A | 9/1965 | Roberts |
| 3,895,701 | A | 7/1975 | Albertson |
| 5,259,278 | A | 11/1993 | Leas |
| 5,765,669 | A | 6/1998 | Adams et al. |
| 5,937,981 | A | 7/1999 | Adams et al. |

(Continued)

OTHER PUBLICATIONS

International Application No. PCT/US18/504492 International Search Report—dated Dec. 31, 2018.

(Continued)

*Primary Examiner* — Robert J Scruggs

(74) *Attorney, Agent, or Firm* — Richard John Bartz; Richard O. Bartz

(57) ABSTRACT

A socket wrench for turning sockets has a handle joined to a head having an inside wall accommodating a body including a socket holder. A permanent magnet attached to the socket holder holds a socket on the socket holder. The body has a plurality of ramps facing the inside wall of the head. Rollers engage the ramps and inside wall. A member mounted on the body engages the rollers to selectively shift the rollers relative to opposite end sections of the ramps. First and second permanent magnets on the body and member maintain the member in selected shifted positions to retain the rollers adjacent the end sections of the ramps.

32 Claims, 11 Drawing Sheets

(56) References Cited

U.S. PATENT DOCUMENTS

| | | | | |
|---|---|---|---|---|
| 5,970,825 | A * | 10/1999 | Barnett | B25B 13/462 81/59.1 |
| 6,044,944 | A | 4/2000 | Adams et al. | |
| 6,067,881 | A | 5/2000 | Albertson | |
| 6,164,166 | A | 12/2000 | Whiteford | |
| 6,516,688 | B2 | 2/2003 | Albertson | |
| 7,069,819 | B2 | 7/2006 | Albertson et al. | |
| 8,210,072 | B2 | 7/2012 | Suter | |
| D670,984 | S | 11/2012 | Albertson | |
| 8,904,907 | B2 | 12/2014 | Douglass | |
| 9,296,093 | B2 | 3/2016 | Ross | |
| 9,902,049 | B2 | 2/2018 | Douglas | |
| 2014/0311302 | A1* | 10/2014 | Taguchi | B25B 23/0035 81/437 |
| 2015/0306745 | A1 | 10/2015 | Ross | |
| 2016/0129562 | A1 | 5/2016 | Douglas | |
| 2016/0193721 | A1 | 7/2016 | Douglas | |

OTHER PUBLICATIONS

International Application No. PCT/US18/504492 Written Opinion of the International Searching Authority—dated Dec. 31, 2018.

* cited by examiner

SOCKET WRENCH

CROSS REFERENCE TO RELATED APPLICATION

This application claims the priority of U.S. Provisional Patent Application Ser. No. 62/557,474 filed Sep. 12, 2017.

FIELD OF THE INVENTION

The invention relates to socket wrenches having reversible one way drive mechanisms that allow infinitely variable reciprocal movements of the wrench handles to selectively rotate sockets in opposite circular directions. The drive mechanisms include devices that are manually adjusted to selectively transmit clockwise or counterclockwise motion to driven members accommodating sockets.

BACKGROUND OF THE INVENTION

Conventional socket wrenches have reversible one way drives that include a ring of internal ratchet teeth and movable pawls engageable with the ratchet teeth to complete the drive couple between the handle and socket driven member. The handle must be angularly moved to a minimum distance to change the interengaging positions of the ratchet teeth and pawls. This limits the use of the wrenches to environments that have sufficient space to allow for the required angular movement of the wrench handle to effect rotation of the socket driven member. These ratchet wrenches are not useable in confined spaces containing nuts and bolts that must be turned on and off threaded members.

D. V. Albertson in U.S. Pat. No. 6,276,239 describes a socket wrench having a reversible one way drive mechanism operable with infinitely variable strokes of a handle to convert reciprocating arcuate movement to stepped rotational movement of a drive member holding a socket. A releasable ball retains a socket or other devices on the drive member. The tool has a handle joined to a head having an inside cylindrical surface. A body having a plurality of ramps is located within the head. Each ramp has an axially extended groove or notch in its middle section to eliminate inadvertent shifting or reverse drive of the drive member. Rollers cooperate with ramps and the inside cylindrical surface of the head to drivably couple the head to the body for one way rotation of the body in response to reciprocating arcuate movement of the handle. The amount of arcuate movement of the handle can be infinitely varied or changed so that the tool can be used in confined spaces to turn nuts and bolts. The tool is efficient and effective in small places as it does not have backlash or play in its roller drive mechanism.

SUMMARY OF THE INVENTION

A socket wrench has a reversible one way roller drive mechanism operable to rotate a socket with small movements of the handle of the wrench. The socket wrench comprises a handle having a head accommodating a selector and a collector. The selector is movable between clockwise and counterclockwise drive positions. The collector has a body with inclined ramps and a socket holder. Rollers cooperate with the ramps and an inside cylindrical wall of the head to drivably couple the head to the collector for selected one way rotation of the collector in response to reciprocating arcuate movements of the handle. Permanent magnets mounted on the selector and collector having the same polarities selectively retain the selector and rollers in clockwise or counterclockwise drive positions. The permanent magnets on the selector and collector have mutual repulsive or separation magnetic forces that retain the selector and rollers in selected clockwise or counterclockwise drive positions. The handle, selector, collector and rollers are coated with a layer of titanium nitride. Alternatively, the socket wench can be titanium or titanium alloy structure. The socket holder has a permanent magnet that holds a socket on the socket holder.

DESCRIPTION OF THE SOCKET WRENCH

Figure 1:
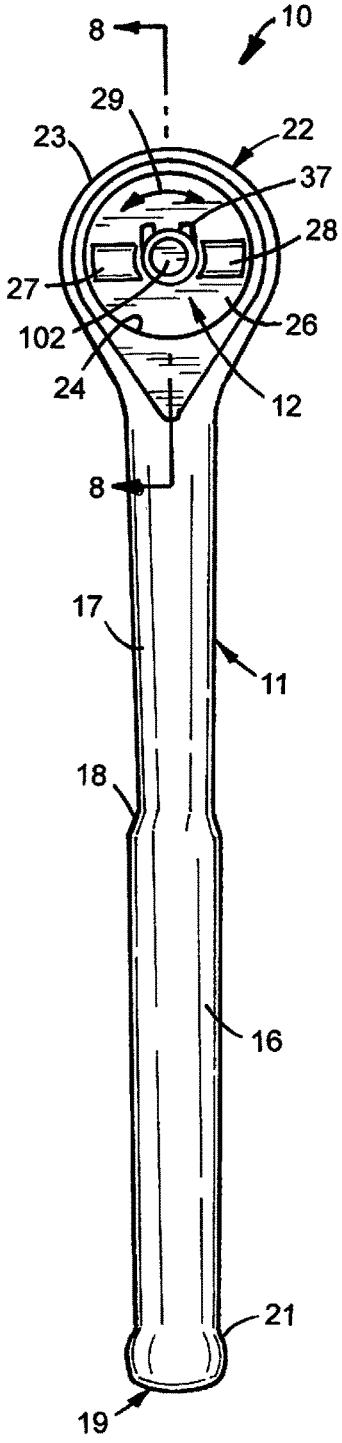
FIG. 1 is a front elevational view of the socket wrench according to an embodiment of the invention.
Figure 2:
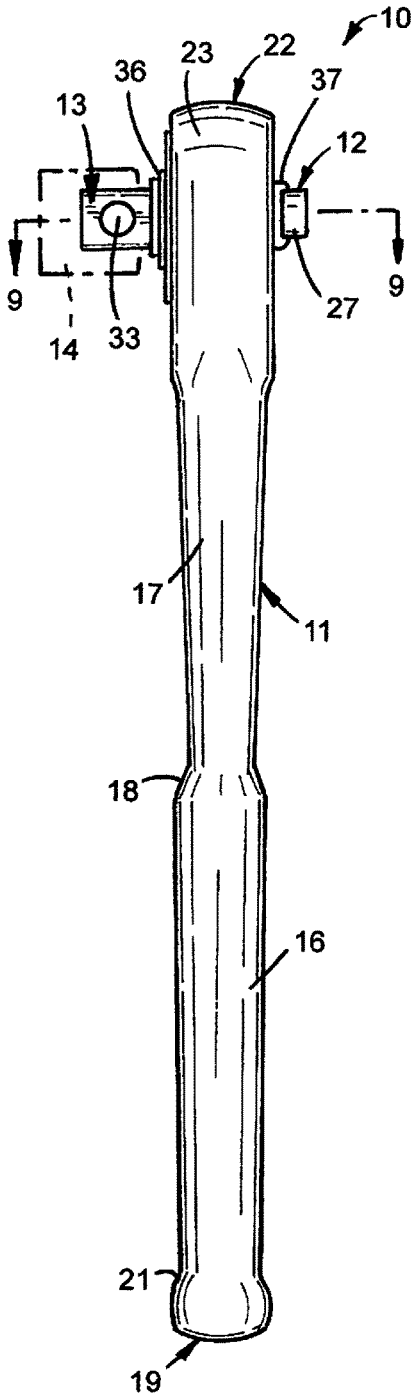
FIG. 2 is a left side elevational view thereof.
Figure 3:
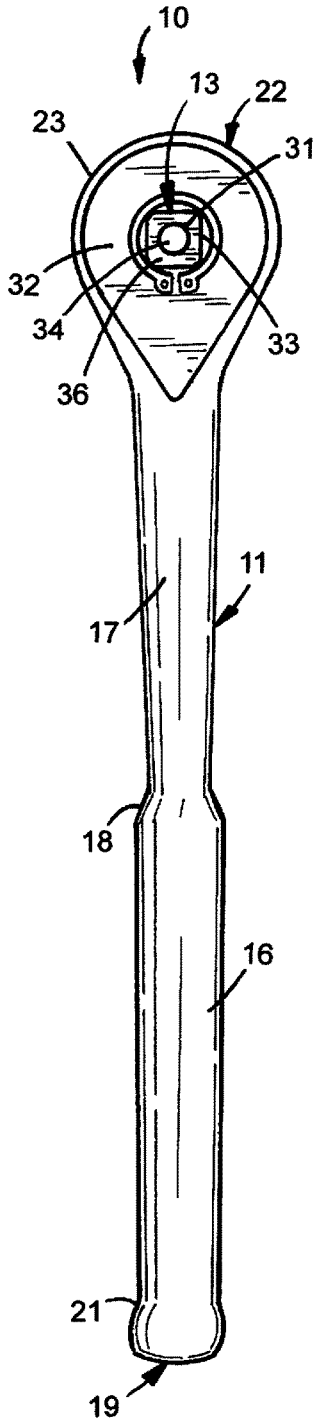
FIG. 3 is a rear elevational view thereof.
Figure 4:
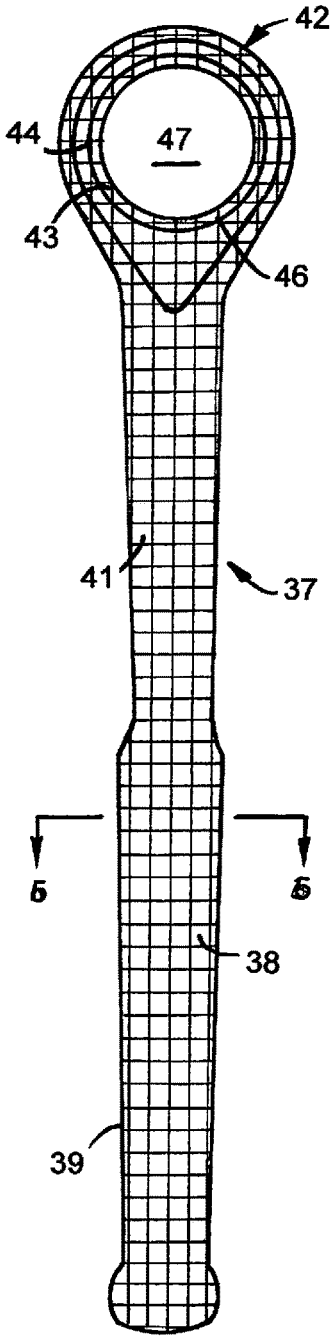
FIG. 4 is a front elevational view of the handle with a titanium nitride exterior surface for a socket wrench.
Figure 5:
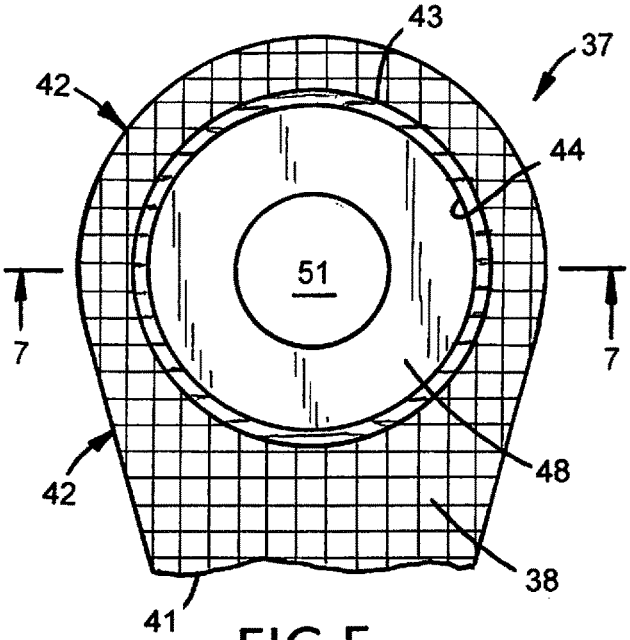
FIG. 5 is an enlarged sectional view of the head of the socket wrench.
Figure 6:
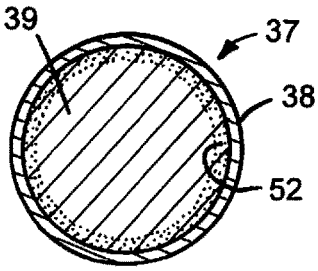
FIG. 6 is a sectional view taken along line 6-6 of FIG. 4.

A socket wrench 10, shown in FIGS. 1 to 3, is a hand tool having an elongated handle 11 accommodating a selector 12 and collector 13. A socket 14 is retained on collector 13. Handle 11 comprises a cylindrical body 16 joined to a cylindrical neck 17. An enlarged annular shoulder 18 joins body 16 to neck 17. The proximal or first end 19 of handle 11 has an enlarged semi-spherical or knob shape with an annular shoulder 21 joining proximal end 19 to body 16. The annular shoulders 18 and 21 facilitate the hand grip of the use of socket wrench 10. The distal or second end of handle 11 has a head 22 rotatably supporting selector 12 and collector 13. Head 22 has a convex generally cylindrical outside surface 23 and a continuous inside cylindrical wall 24. Selector 12 includes a member 26 having upright ears 27 and 28 located on opposite sections of member 26. The ears 27 and 28 are hand engaging projections that facilitate the hand turning of selector 12, shown by arrows 29 in FIG. 1, to select the clockwise or counterclockwise drive of collector 13 that is responsive to oscillating movements of handle 11. Collector 13 includes a square drive member or socket holder 31 extended laterally away from a bottom wall 32 of head 22. Socket holder 31 supports a ball detent 33 and stem 34 that controls the socket lock and unlock positions of ball detent 33. A C-clamp or snap ring 36 around drive member 31 and C-clamp or snap ring 37 on member 26 retains socket 12 and collector 13 on head 22.

Handle 11 is a one-piece carbon steel member or a stainless steel member. Coatings or films, such as titanium nitride, titanium carbide and titanium silicon nitride can be deposited on the exterior surfaces of handle 11 to reduce chipping, surface wear and eliminate corrosion. Sector 12 and collector 13 can also be coated with titanium nitrides and carbides. Titanium nitride (TIN) coatings on handle 11, selector 12 and collector 13 provide hard smooth surfaces having a gold color without causing distortion or loss of metal hardness.

Figure 7:
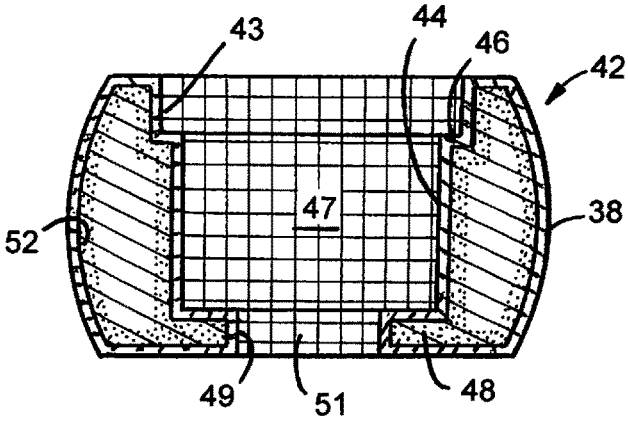
FIG. 7 is a sectional view taken along line 7-7 of FIG. 5.

Proceeding to FIGS. 4 to 7, a socket wrench handle 37 has a coating or exterior layer of titanium nitride (TIN) 38. Handle 37 includes a cylindrical body 39 joined to a cylindrical neck 41. The distal end of neck 41 is integrated with a cylindrical head 42. As shown in FIG. 7, head 42 has a first inside cylindrical wall 43 and a second cylindrical wall 44. Wall 43 has a diameter greater than the diameter of wall 44. A radial shoulder 46 is located between walls 43 and 44. Walls 43 and 44 surround a cylindrical blind bore 47 extended to a bottom wall 48. Wall 48 has a third cylindrical wall 49 surrounding an opening or hole 51 open to bore 47.

Handle 37 is a carbonated one-piece structure heat treated to Rockwell hardness 42-44 (HRC 42-44). The titanium nitride coating 38 is a thin layer having a uniform thickness of approximately 2 to 8 microns. A diffusion zone 52 of titanium nitride integrates or alloys coating 38 with the core steel of handle 37. The diffusion zone 52 provides excellent bonding of the titanium nitride coating 38 to walls 43, 44 and 49. The methods of titanium nitride thin film creation are physical vapor deposition and chemical vapor deposition. Pure titanium is sublimed and reacted with nitrogen in a high-energy, vacuum environment. Examples of titanium coating processes of ferrous metal are disclosed in U.S. Pat. Nos. 3,071,491; 5,178,091 and 5,308,367 incorporated herein by reference.

An alternative coating of titanium, silicon, nitride (TI-SI-N) can be deposited on handle 37 by physical vapor deposition to improve the wear resistance of the coating. The coating has a composite structure consisting of titanium nitride nanocrystallites embedded in amorphous silicon nitride.

Figure 8:
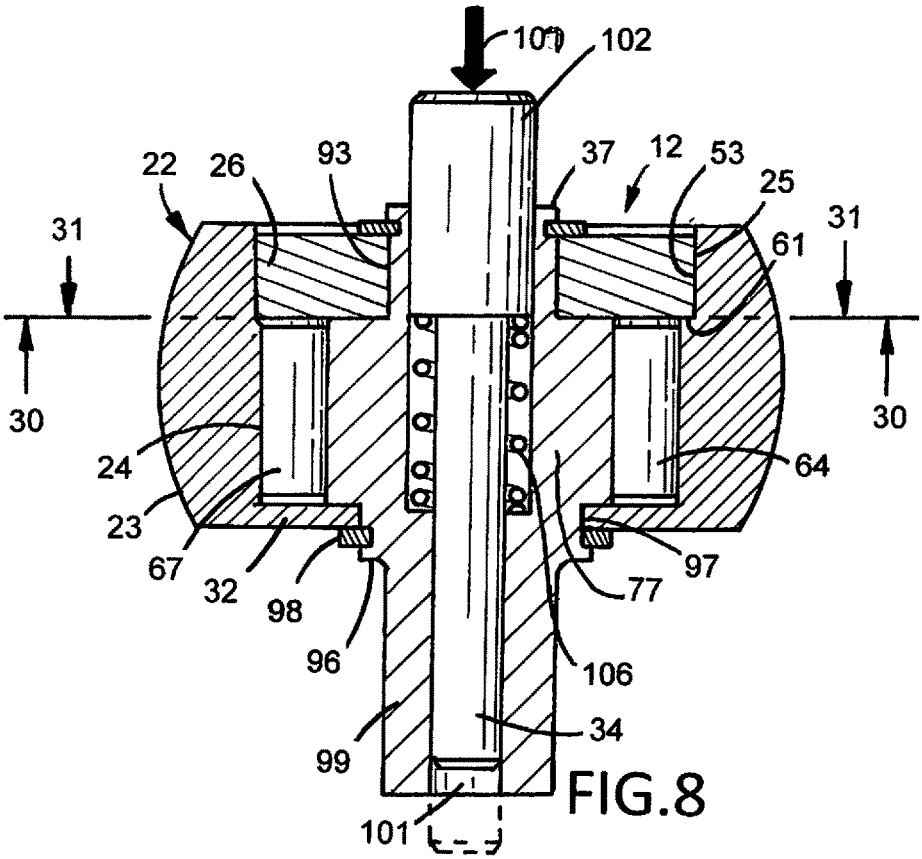
FIG. 8 is an enlarged sectional view taken along line 8-8 of FIG. 1.
Figure 9:
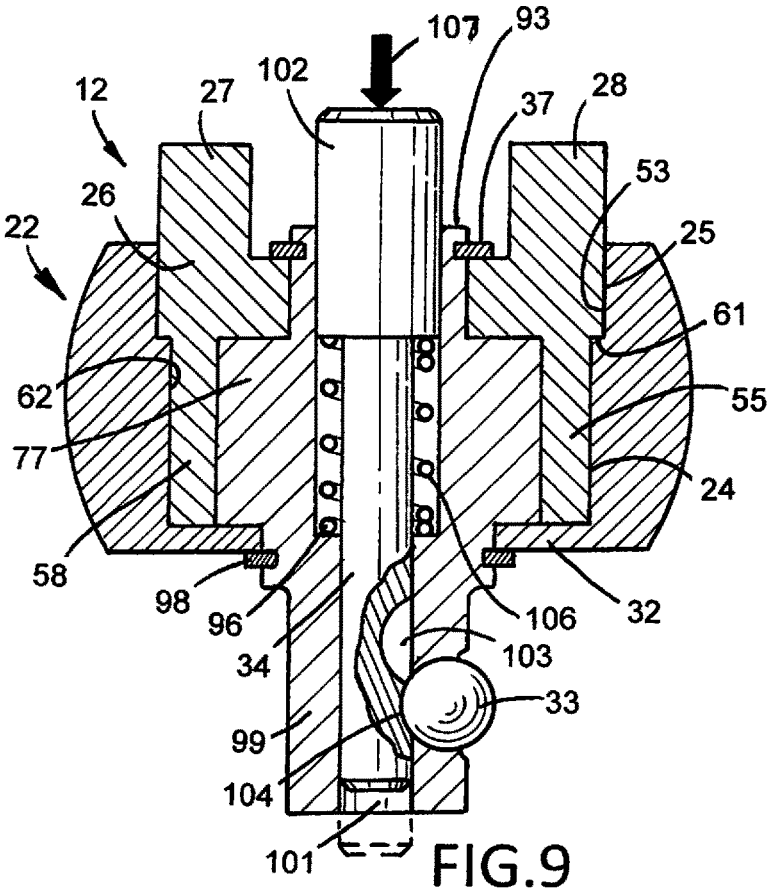
FIG. 9 is an enlarged sectional view taken along line 9-9 of FIG. 2.
Figure 10:
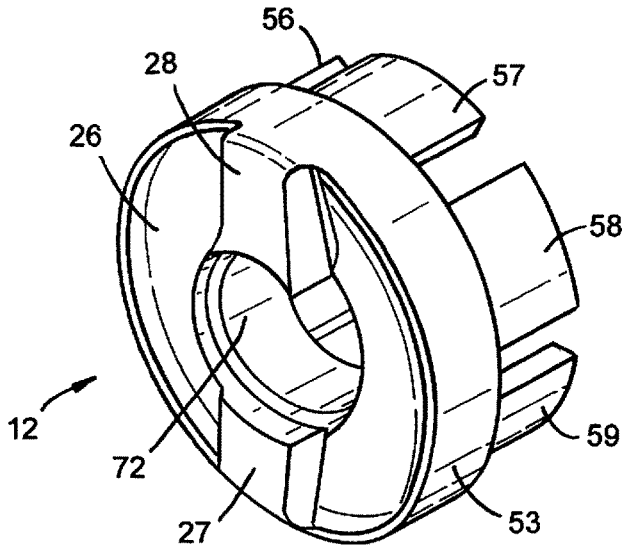
FIG. 10 is a perspective view of the selector of the socket wrench of FIG. 1.
Figure 11:
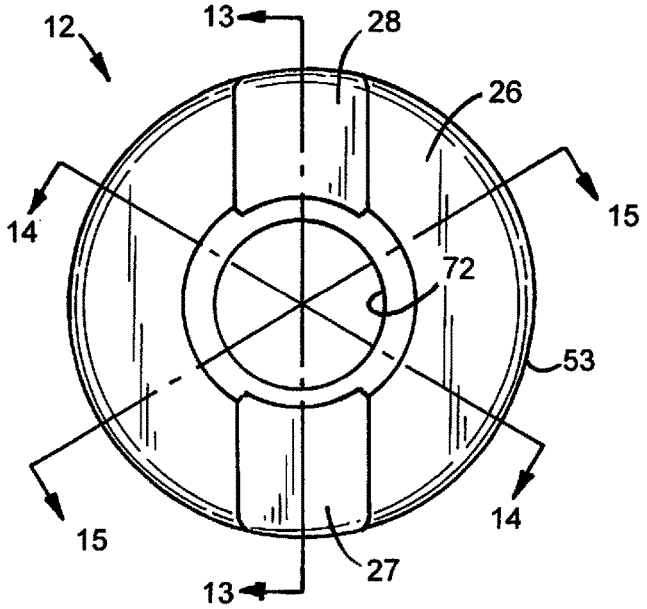
FIG. 11 is a top plan view of FIG. 10.
Figure 12:
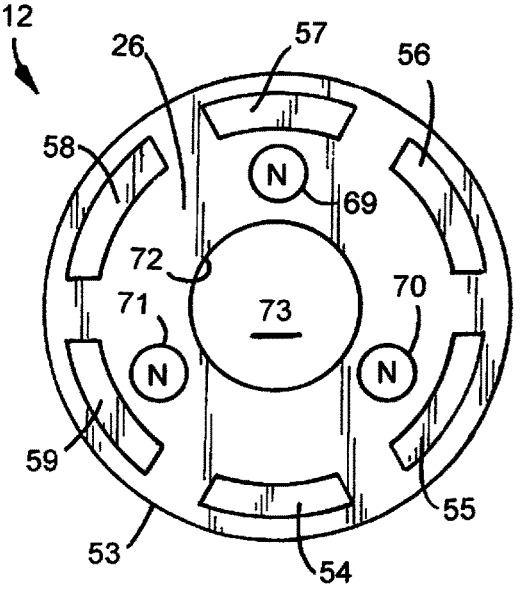
FIG. 12 is a bottom plan view of FIG. 10.
Figure 30:
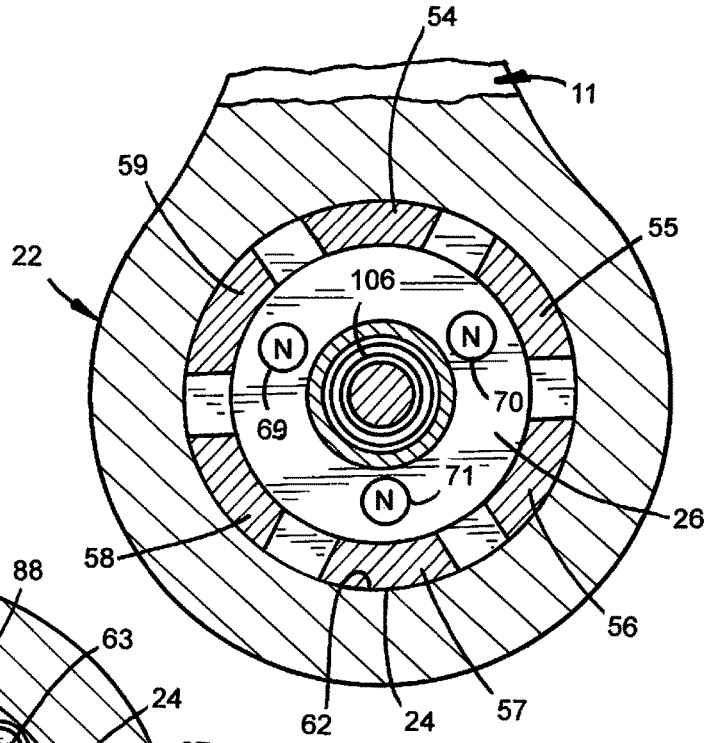
FIG. 30 is a sectional view taken along line 30-30 of FIG. 8.
Figure 31:
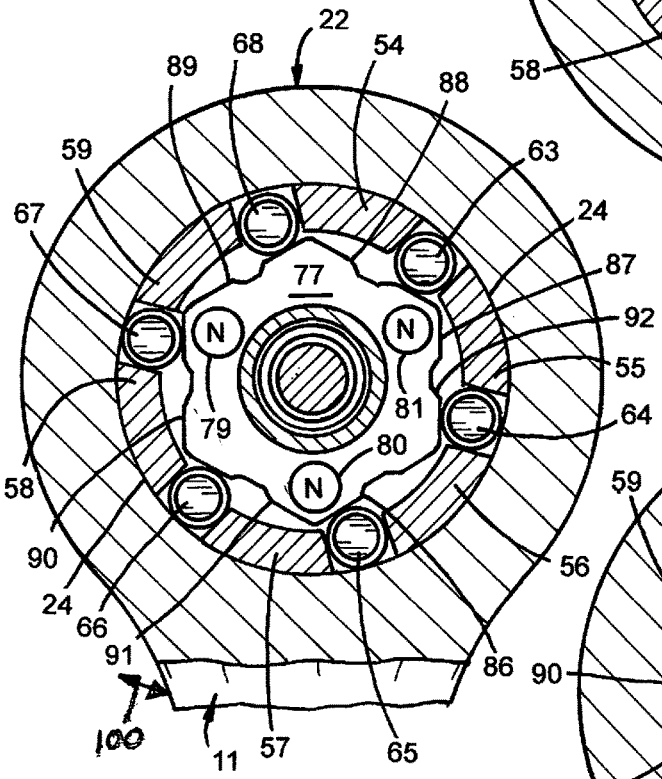
FIG. 31 is a sectional view taken along line 31-31 of FIG. 8 showing the drive positions of the rollers for clockwise driving of the socket wrench.
Figure 32:
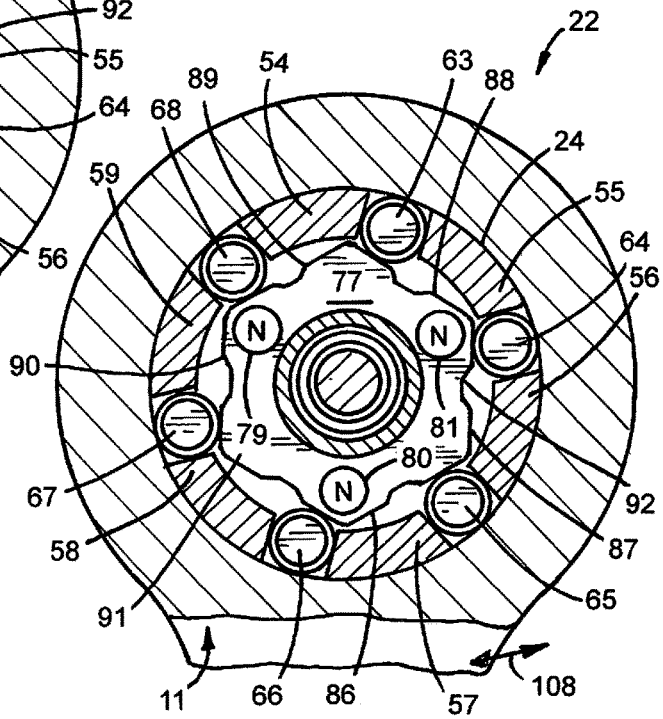
FIG. 32 is a sectional view similar to FIG. 31 showing the drive positions of the rollers for counterclockwise driving of the socket wrench.
Figure 33:
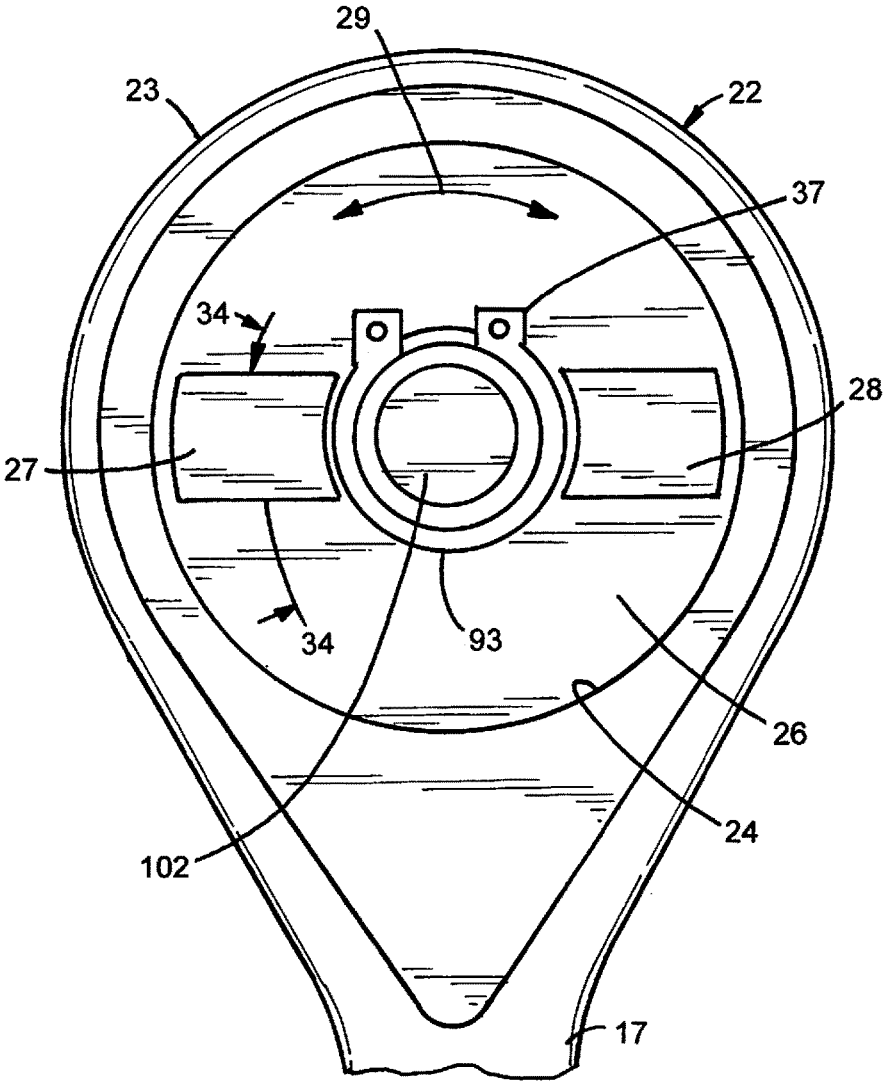
FIG. 33 is an enlarged top plan view of the head of the socket wrench shown in FIG. 1.

As shown in FIGS. 8, 9 and 30 to 32, selector 12 comprises a cylindrical member or body 26 having a cylindrical peripheral surface 53 located adjacent cylindrical wall 25 of head 22. Surface 53 can be in sliding surface contact with wall 25. The bottom peripheral circular edge of member 26 engages a shoulder 61 located between walls 24 and 25. As shown in FIGS. 9 and 30, a plurality of arcuate segments or legs 54, 55, 56, 57, 58 and 59 joined to the bottom of member 26 extend into head 22 and engage bottom wall 32. Each of legs 54, 55, 56, 57, 58 and 59 have outside arcuate surfaces 62 located in sliding surface engagement with wall 24. Adjacent legs are circumferentially spaced from each other to accommodate cylindrical rollers 63, 64, 65, 66, 67 and 68. As shown in FIG. 30, three cylindrical permanent magnets 69, 70 and 71 are embedded into the bottom of member 26. Adjacent magnets 69,70; 70,71 and 69,71 are circumferentially spaced 120 degrees from each other. Magnets 69, 70 and 71 have the same polarity, shown as north, N. The polarity can be south, S. Examples of permanent magnets 69, 70 and 71 are neodymium cylinder magnets.

Figure 13:
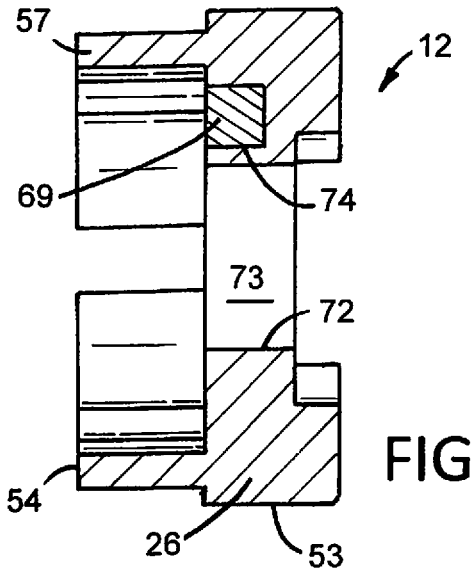
FIG. 13 is a sectional view taken along line 13-13 of FIG. 11.
Figure 14:
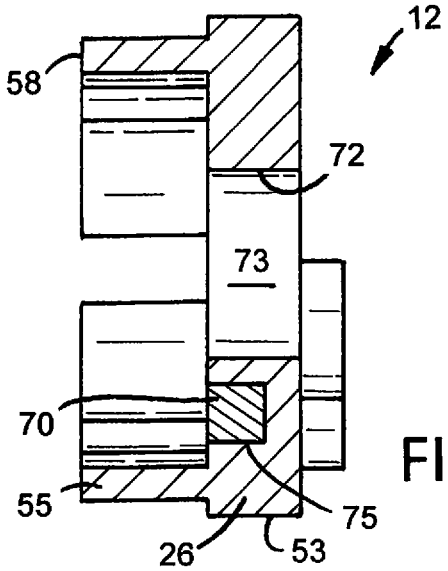
FIG. 14 is a sectional view taken along line 14-14 of FIG. 11.
Figure 15:
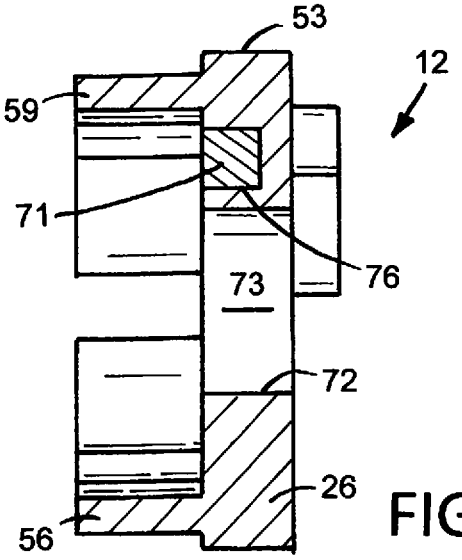
FIG. 15 is a sectional view taken along line 15-15 of FIG. 11.
Figure 16:
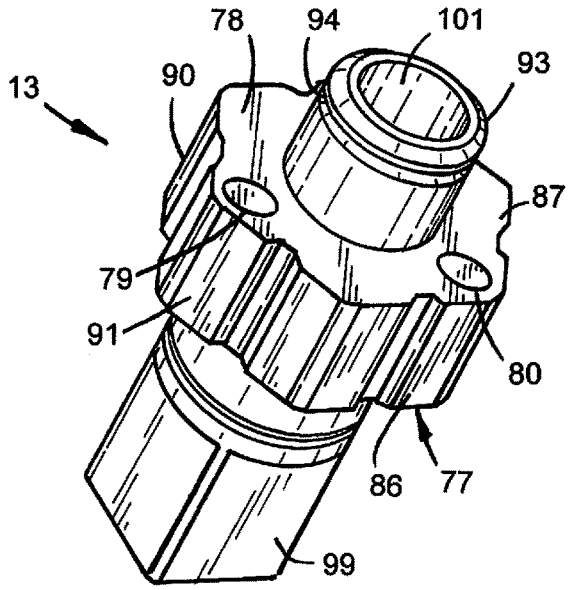
FIG. 16 is a perspective view of a first embodiment of the collector for the socket wrench of FIG. 1.
Figure 17:
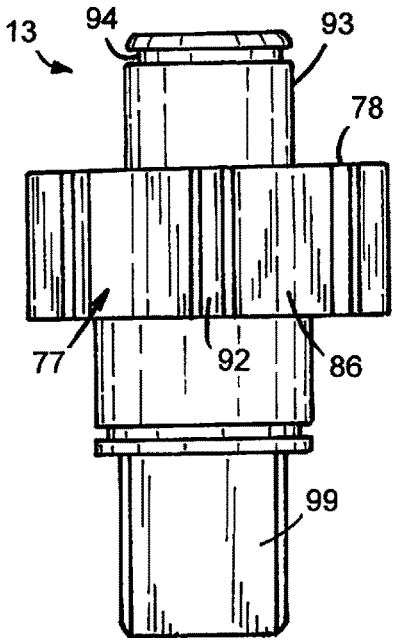
FIG. 17 is a front elevational view of FIG. 16.
Figure 18:
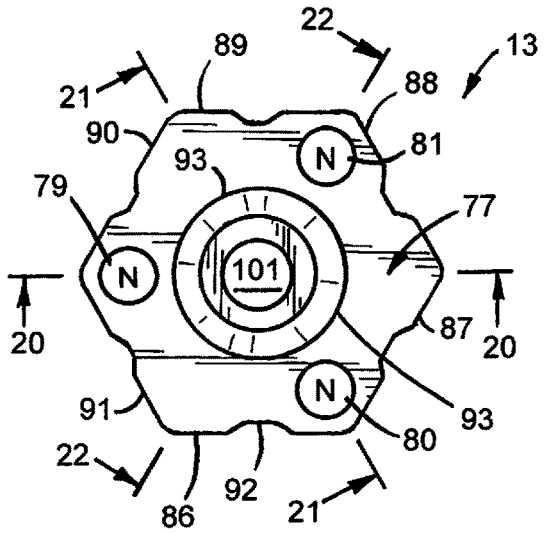
FIG. 18 is a top plan view of FIG. 16.
Figure 19:
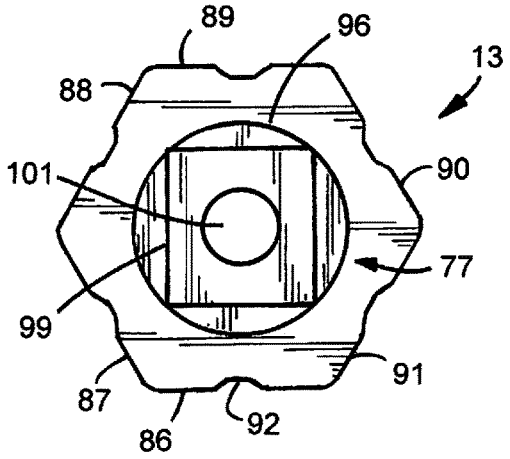
FIG. 19 is a bottom plan view of FIG. 16.
Figure 20:
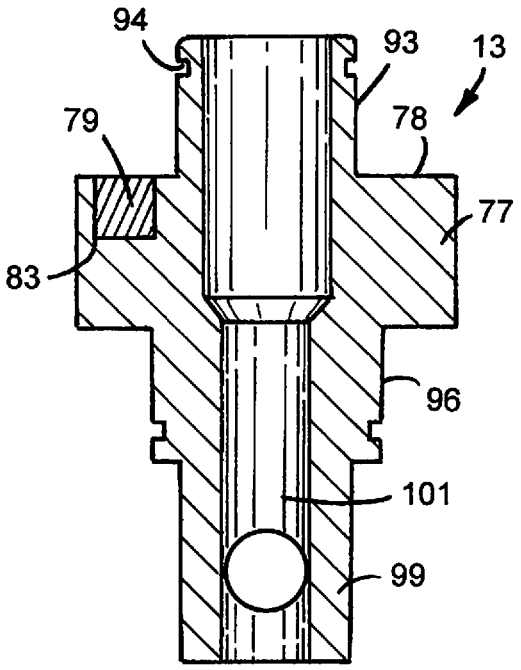
FIG. 20 is a sectional view taken along line 20-20 of FIG. 18.
Figure 21:
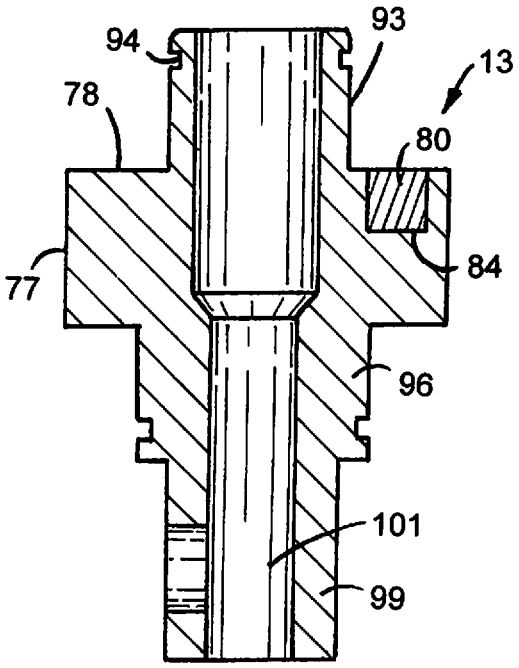
FIG. 21 is a sectional view taken along line 21-21 of FIG. 18.
Figure 22:
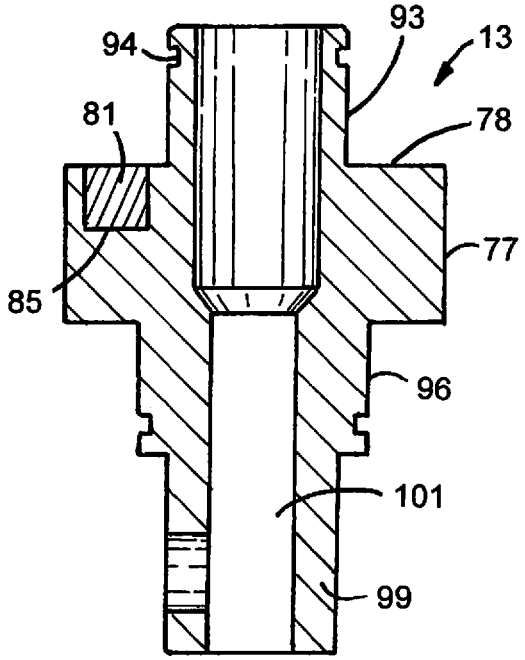
FIG. 22 is a sectional view taken along line 22-22 of FIG. 18.
Figure 23:
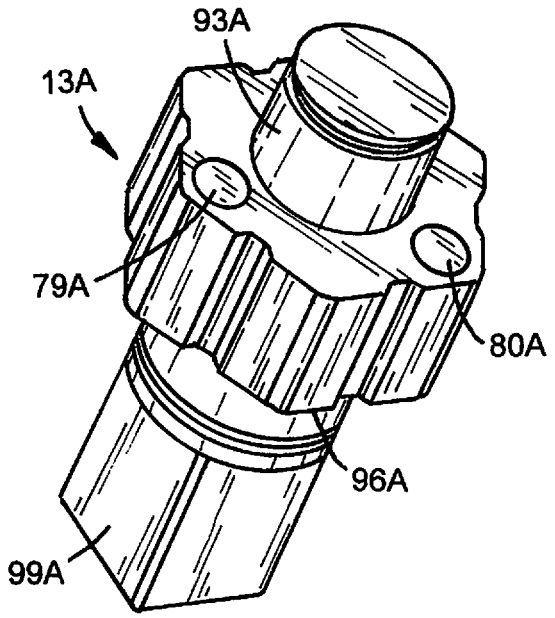
FIG. 23 is a perspective view of a second embodiment of the collector for the socket wrench of FIG. 1.
Figure 24:
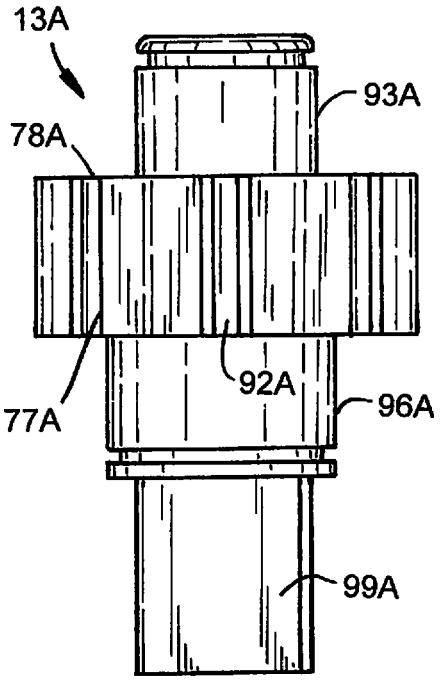
FIG. 24 is a front elevational view of FIG. 23.
Figure 25:
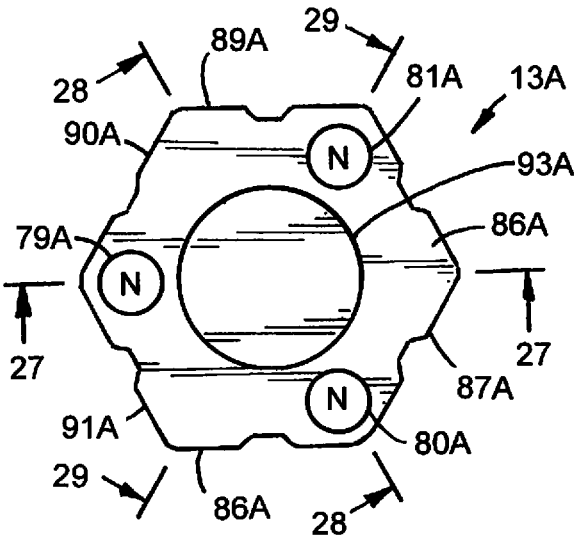
FIG. 25 is a top plan view of FIG. 23.
Figure 26:
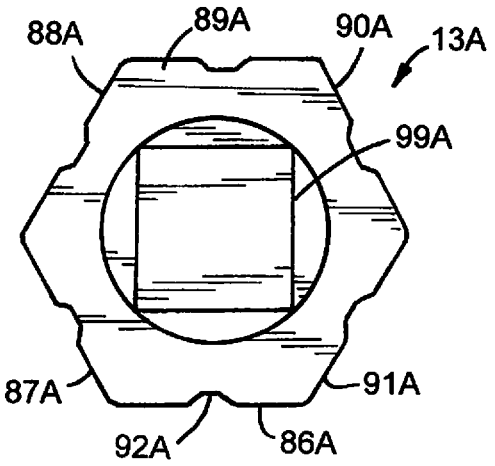
FIG. 26 is a bottom view of FIG. 23.

Proceeding to FIGS. 10 to 15, selector 12 has a central cylindrical wall 72 surrounding an opening 73. Ears 27 and 28 are located adjacent opposite portions of opening 73. Member 26, ears 27 and 28 and legs 54, 55, 56, 57, 58 and 59 are a one-piece metal selector. The metal of the one-piece selector is aluminum. Other metals including titanium maybe used to fabricate the one-piece selector. As shown in FIGS. 13, 14 and 15, permanent magnets 69, 70 and 71 are located in cylindrical pockets 74, 75 and 76 in member 26. The permanent magnets 69, 70 and 71 have circular flat ends aligned with the inside surface of the bottom of member 26.

Collector 13, shown in FIGS. 16 to 22, comprises a body 77 having a top wall 78 accommodating cylindrical permanent magnets 79, 80 and 81. Permanent magnets 79, 80 and 81 have circular flat ends aligned with the top surface of body 77. As shown in FIGS. 13, 14, 15, 16, 34 and 35, the ends of first permanent magnets 69, 70 and 71 and the ends of second permanent magnets 79, 80 and 81 are located in a common plane between the top surface of body 77 and the bottom surface of member 26. Body 77 has cylindrical pockets 83, 84 and 85 accommodating magnets 79, 80 and 81. Adjacent magnets 79, 80 and 81 are circumferentially spaced from each other 120 degrees. Each magnet has the same polarity shown as north N. The magnets can have the same polarity south S. Magnets 79, 80 and 81 are circumferentially aligned with selector magnets 69, 70 and 71 when selector 12 and collector 13 are assembled on handle 11.

Body 77 has six tangent ramps 86, 87, 88, 89, 90 and 91 around its outer surface. Each ramp has opposite end sections and an upright groove or recess 92 in the middle section of the ramp 86. Recess 92 is an arcuate segment of a circle having a radius generally equal to the diameter of roller 63. Recess 92 can be U-shaped or a channel shaped notch. In use, recess 92 provides a location for roller 64 in the middle of the ramp 86 to allow roller 64 to retract inwardly away from wall 24 to prevent roller 64 from shifting beyond the center of the ramp 87 to the opposite drive position. Ramps 86, 87, 88, 89, 90 and 91 have central recesses that accommodate rollers 63, 64, 65, 66, 67 and 68. A first cylindrical sleeve 93 projecting upwardly from body 77 has an annular groove 94 accommodating a C-ring 37. As shown in FIGS. 8 and 9, ring 96 engages the top of member 26 and maintains member 26 in contact with shoulder 61 of head 22. A second cylindrical sleeve 97 extended downward from body 77 projects through hole 97 in bottom wall 32 of head 22. A C-ring 98 mounted on sleeve 97 engages bottom wall 32 to retain collector 13 on head 22.

A socket holder 99 joined to sleeve 96 has a square configuration to retain socket 14. Body 77 and sleeves 92 and 93 have a central bore 101. A stem 102 located in bore 101 has a recess 103 accommodating detent ball 33. Recess 103 is open to groove 104 in stem 102. When detent ball 33 is located in groove 104, stem 102 retains detent ball 33 in a socket lock position. A coil spring 106 biases stem 102 in an upward detent ball lock position. When stem 102 is moved down, shown by arrow 107, recess 103 is aligned with detent ball 33 to allow detent ball 33 to move to its socket unlock position whereby the socket can be removed from socket holder 99.

FIGS. 23 to 29 illustrate a modification of the collector 13A for the socket wrench 10. Collector 13A has the same structure including the permanent magnets shown in FIGS. 16 to 22 except for the detent ball lock and unlock stem 102 and bore 101 accommodating the stem 102 and biasing spring 106. The structures of FIGS. 23 to 29 that correspond to structures of FIGS. 16 to 22 have the same reference numbers with suffice A. Collector 13A has permanent magnets 79A, 80A and 81A that coact with magnets 69, 70 and 71 of selector 12 to position rollers 63 to 68 relative to ramps 86 to 91. The selector permanent magnets 69, 70 and 71 and collector permanent magnets 79A, 80A and 81A have the same external polarities, north N, resulting in repulsive magnetic forces that control and retain the position of member 26A to located rollers 63, 64, 65, 66, 67 and 68 relative to ramps 86, 87. 88, 89, 90 and 91.

Figure 27:
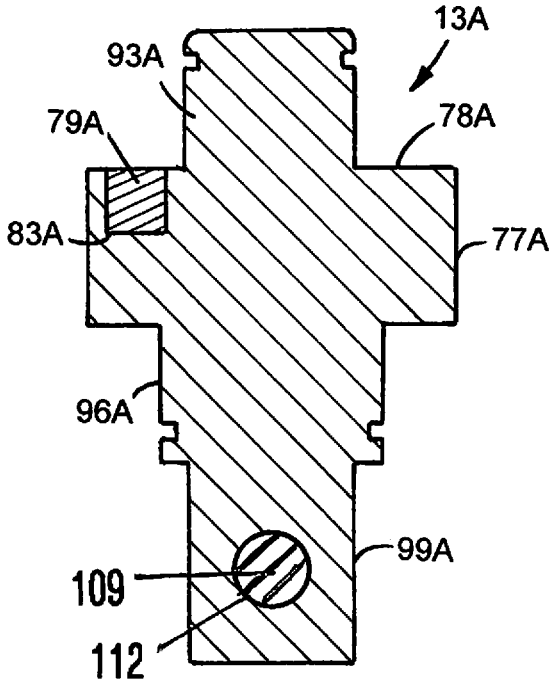
FIG. 27 is a sectional view taken along line 27-27 of FIG. 25.
Figure 28:
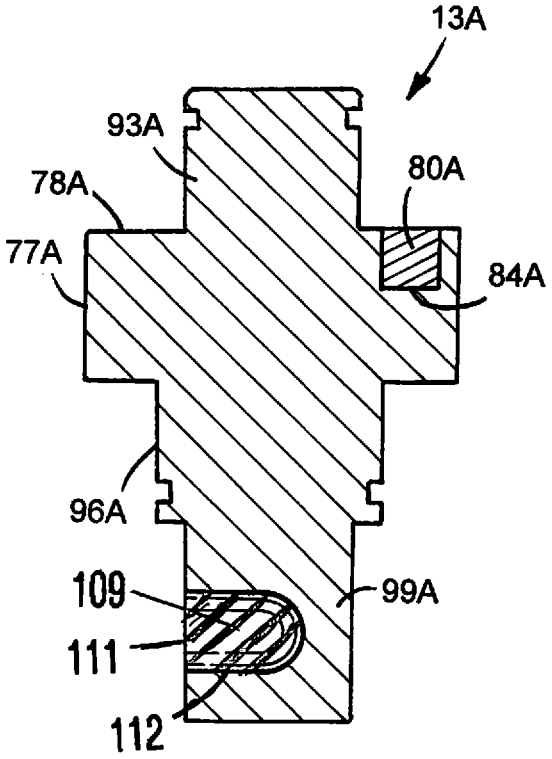
FIG. 28 is a sectional view taken along line 28-28 of FIG. 25.
Figure 29:
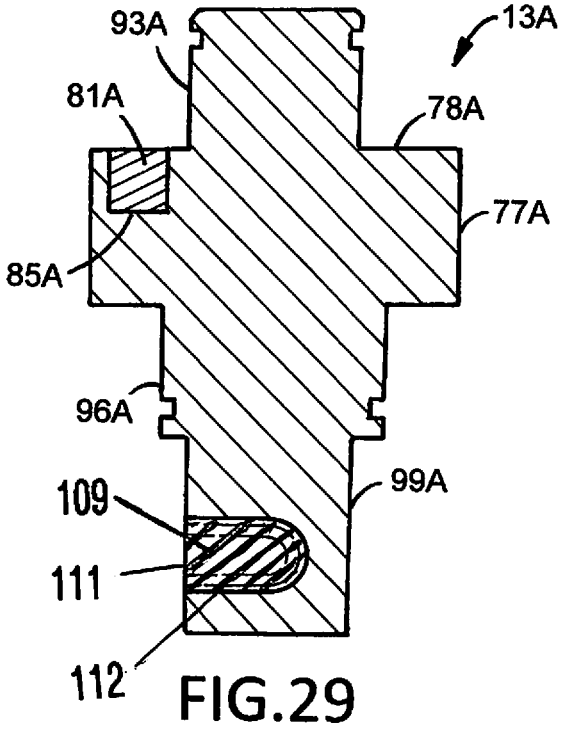
FIG. 29 is a sectional view taken along line 29-29 of FIG. 25.

As shown in FIGS. 27 to 29, socket holder 99A has a lateral recess 112 or blind cylindrical hole. A cylindrical permanent magnet 109 is retained in recess 112. Magnet 109 has an external surface or face 111 coextensive with the outside wall of socket holder 99A. Magnet 109 is a N52 neodymium cylindrical magnet. Other types and shapes of permanent magnets can be retained in recess 112. Magnet 109 has a magnetic force that holds a wrench socket on socket holder 99A.

Figure 34:
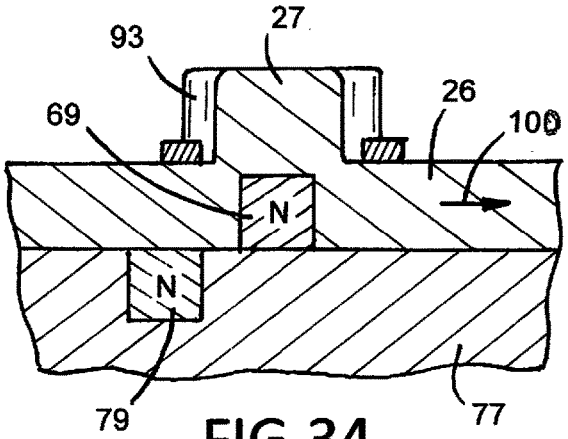
FIG. 34 is a sectional view taken along line 34-34 of FIG. 33 showing the clockwise drive location of the permanent magnets on the selector and collector.
Figure 35:
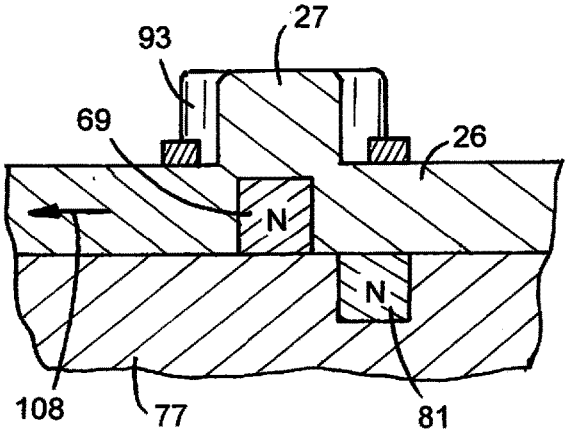
FIG. 35 is a sectional view according to FIG. 34 showing the counterclockwise drive location of the permanent magnets on the selector and collector.

In use, the selector permanent magnets 69, 70 and 71 coact with the collector permanent magnets 79, 80 and 81 to selectively position rollers 63, 64, 65, 66, 67 and 68 on opposite portions of ramps 86, 87, 88, 89, 90 and 91. Rollers 63, 64, 65, 66, 67 and 68 are wedged between ramps 86, 87, 88, 89, 90 and 91 and wall 24 of head 22 whereby oscillating movements of the handle 11, shown by arrows 100 and 108, transmit torque from handle 11 to collector 13 in clockwise and counterclockwise directions. The selector permanent magnets 69, 70 and 71 and collector permanent magnets 79, 80 and 81 have the same external polarities, north N, resulting in repulsive magnetic forces that control and retain the positions of rollers 63, 64, 65, 66, 67 and 68 relative to ramps 86, 87, 88, 89, 90 and 91. As shown in FIG. 34, first and second permanent magnets 69 and 70 with north N polarity oppose each other to move and retain body 26 of the selector in the direction of arrow 100. The opposing magnetic force is constant. The magnets 69 and 70 have outside end faces along a generally common plane. Detents are not used to retain the position of the selector relative to the collector. FIG. 35 shows magnets 69 and 81 operable to move and retain selector body 26 in the direction of arrow 108. Magnets 69 and 81 have the same north N polarity resulting in an opposing magnet force that controls the positions of body 26 and rollers 63, 64, 65, 67 and 68 relative to ramps 86, 87, 88, 89, 90 and 91 whereby oscillating movements of handle 11 results in intermittent rotation of body 26 and socket holder 99.

The socket wrench illustrated and described includes several embodiments of the invention. Variations and modifications of the handle, selector, collector, magnets and the number of rollers, arrangement of these structures and materials can be made by a person skilled in the art without departing from the scope and content of the invention.

The invention claimed is:

1. A socket wrench for rotating a socket comprising:
a handle,
a head joined to the handle,
the head including an inside cylindrical wall surrounding a bore,
a body located within the bore of the head,
a socket holder joined to the body for accommodating a socket,
a permanent magnet retained on the socket holder for holding the socket on the socket holder,
the body including a plurality of ramps facing the inside cylindrical wall of the head,
each ramp having opposite end sections,
a roller located between each ramp and the inside cylindrical wall of the head and engageable with each ramp and inside cylindrical wall,
a first member operable to selectively shift each roller adjacent to the opposite end sections of the ramp adjacent to each roller,
a second member rotatably mounted on the head operably connected to the first member to rotate the first member,
a plurality of first permanent magnets mounted on the body,
a plurality of second permanent magnets mounted on the second member,
the plurality of first permanent magnets having the same polarity as the plurality of the second permanent magnets whereby repulsive magnetic forces exist between adjacent plurality of the first and second permanent magnets, and
the plurality of the first permanent magnets on the body and the plurality of the second permanent magnets on the member being located relative to each other whereby the repulsive magnetic forces between the adjacent plurality of the first and second permanent magnets retain the member in a selected shifted position to locate each roller adjacent an end section of a ramp whereby oscillating movements of the handle results in intermittent rotation of the body and socket holder.

2. The socket wrench of claim 1 wherein:
the socket holder has a recess, and
said permanent magnet being located in said recess.

3. The socket wrench of claim 1 wherein:
the socket holder has a side wall,
a recess open to the side wall,
said permanent magnet being located in said recess, and
said permanent magnet having an end aligned with the side wall of the socket holder.

4. The socket wrench of claim 3 wherein:
the permanent magnet is a neodymium magnet.
5. The socket wrench of claim 1 wherein:
the plurality of first permanent magnets comprise three first permanent magnets, and
the plurality of second permanent magnets comprise three second permanent magnets.
6. The socket wrench of claim 5 wherein:
adjacent three first permanent magnets are circumferentially spaced 120 degrees from each other, and
adjacent three second permanent magnets are circumferentially spaced 120 degrees from each other.
7. The socket wrench of claim 1 wherein:
the plurality of first permanent magnets having first ends,
the plurality of second permanent magnets having second ends, and
said first ends and second ends having the same polarity.
8. The socket wrench of claim 7 wherein:
the first ends of the first permanent magnets and the second ends of the second permanent magnets are located in a generally common plane between the body and the member.
9. The socket wrench of claim 7 wherein:
the first ends of the first permanent magnets and the second ends of the second permanent magnets each have a north polarity.
10. The socket wrench of claim 1 wherein:
the first member includes arcuate segments located between adjacent rollers.
11. The socket wrench of claim 1 including:
a coating of a titanium alloy on the handle, head and inside cylindrical wall of the head.
12. The socket wrench of claim 11 wherein:
the coating of titanium alloy comprises titanium nitride.
13. The socket wrench of claim 12 wherein:
the plurality of first permanent magnets having first ends,
the plurality of second permanent magnets having second ends, and
said first ends and second ends having the same polarity.
14. The socket wrench of claim 13 wherein:
the first ends of the first permanent magnets and the second ends of the second permanent magnets are located in a generally common plane between the body and the member.
15. The socket wrench of claim 13 wherein:
the first ends of the first permanent magnets and the second ends of the second permanent magnets each have a north polarity.
16. A socket wrench for rotating a socket comprising:
a handle,
a head joined to the handle,
the head including an inside cylindrical wall surrounding a bore,
a body located within the bore of the head,
a socket holder joined to the body for accommodating a socket,
the body including a plurality of ramps facing the inside cylindrical wall of the head,
each ramp having opposite end sections,
a roller located between each ramp and the inside cylindrical wall of the head and engageable with each ramp and inside cylindrical wall,
a member mounted on the body operable to selectively shift each roller adjacent to the opposite end sections of the ramp adjacent to each roller,
a plurality of first permanent magnets mounted on the body,
a plurality of second permanent magnets mounted on the member,
the plurality of first permanent magnets having the same polarity as the plurality of the second permanent magnets whereby repulsive magnetic forces exist between adjacent plurality of the first and second permanent magnets, and
the plurality of the first permanent magnets on the body and the plurality of the second permanent magnets on the member being located relative to each other whereby the repulsive magnetic forces between the adjacent plurality of the first and second permanent magnets retain the member in a selected shifted position to locate each roller adjacent an end section of a ramp whereby oscillating movements of the handle results in intermittent rotation of the body and socket holder.
17. The socket wrench of claim 16 wherein:
the plurality of first permanent magnets comprise three first permanent magnets, and
the plurality of second permanent magnets comprise three second permanent magnets.
18. The socket wrench of claim 17 wherein:
adjacent three first permanent magnets are circumferentially spaced 120 degrees from each other, and
adjacent three second permanent magnets are circumferentially spaced 120 degrees from each other.
19. The socket wrench of claim 16 including:
a coating of titanium alloy on the handle, head and inside cylindrical wall of the head.
20. The socket wrench of claim 16 wherein:
the member has a first part operable to selectively shift each roller adjacent to the opposite end sections of the ramp adjacent to each roller, and a second part rotatably mounted on the head and operably connected to the first part to rotate the first part, and
the plurality of second permanent magnets being mounted on the second part of the member.
21. The socket wrench of claim 20 wherein:
the first part of the member has arcuate segments and slots between the arcuate segments, said slots accommodating the rollers.
22. A socket wrench for rotating a socket comprising:
a handle,
a head joined to the handle,
the head including an inside cylindrical wall surrounding a bore,
a body located within the bore of the head,
a socket holder joined to the body for accommodating a socket,
the body including a plurality of ramps facing the inside cylindrical wall of the head,
each ramp having opposite end sections,
a roller located between each ramp and the inside cylindrical wall of the head,
each roller being selectively engageable with the opposite end sections of each ramp to transmit torque to the body and socket holder upon arcuate movement of the handle,
a member mounted on the body operable to selectively shift each roller adjacent to the opposite end sections of a ramp,
at least one first permanent magnet mounted on the body,
at least one second permanent magnet mounted on the member,
the at least one first permanent magnet has the same polarity as the at least one second permanent magnet whereby a repulsive magnetic force exists between adjacent the at least one first permanent magnet and the at least one second permanent magnet, and the at least one first permanent magnet on the body and the at least one second permanent magnet on the member being located relative to each other whereby the repulsive magnetic force between the at least one first permanent magnet and the at least one second permanent magnet retains the member in a selected shifted position to locate each roller adjacent an end section of a ramp whereby oscillating movements of the handle results in intermittent rotation of the body and socket holder.

23. The socket wrench of claim 22 wherein:

the at least one first permanent magnet has a first end, the at least one second permanent magnet having a second end, and said first end and second end having the same polarity.

24. The socket wrench of claim 23 wherein:

the first end of the at least one first permanent magnet and the second end of the at least one second permanent magnet are located in a generally common plane between the body and the member.

25. The socket wrench of claim 23 wherein:

the first end of the at least one first permanent magnet and the second end of the at least one second permanent magnet each have a north polarity.

26. The socket wrench of claim 22 including:

a coating of titanium alloy on the handle, head and inside cylindrical wall of the head.

27. The socket wrench of claim 22 wherein:

the member has a first part operable to selectively shift each roller adjacent to the opposite end sections of the ramps adjacent each roller, and a second part rotatably mounted on the head and operably connected to the first part to rotate the first part, and the at least one second permanent magnet being mounted on the second part of the member.

28. The socket wrench of claim 27 wherein:

the first part of the member has arcuate segments and slots between the arcuate segments, said slots accommodating the rollers.

29. A socket wrench for rotating a socket comprising:

a handle, a head joined to the handle, the head including an inside cylindrical wall surrounding a bore, a body located within the bore of the head, a socket holder joined to the body for accommodating a socket, the body including a plurality of ramps facing the inside cylindrical wall of the head, each ramp having opposite end sections, a cylindrical roller located between each ramp and the inside cylindrical wall of the head and engageable with each ramp and the inside cylindrical wall of the head, a member located within the bore of the head, a plurality of segments connected to the member and surrounding the body, adjacent segments being circumferentially spaced from each other providing an opening accommodating the cylindrical roller, said member being operable to selectively shift the segments and each roller adjacent to the opposite end sections of the ramp adjacent to each roller, a plurality of first permanent magnets mounted on the body, a plurality of second permanent magnets mounted on the member, the plurality of first permanent magnets having the same polarity as the plurality of the second permanent magnets whereby repulsive magnetic forces exist between adjacent plurality of the first and second permanent magnets, and the plurality of the first permanent magnets on the body and the plurality of the second permanent magnets on the member being located relative to each other whereby the repulsive magnetic forces between the adjacent plurality of the first and second permanent magnets retain the member and the plurality of segments in a selected shifted position to locate each cylindrical roller adjacent an end section of a ramp whereby oscillating movements of the handle results in intermittent rotation of the body and the socket holder.

30. The socket wrench of claim 29 wherein:

the plurality of first permanent magnets comprise three first permanent magnets, and the plurality of second permanent magnets comprise three second permanent magnets.

31. The socket wrench of claim 30 wherein:

adjacent three first permanent magnets are circumferentially spaced 120 degrees from each other, and adjacent three second permanent magnets are circumferentially spaced 120 degrees from each other.

32. The socket wrench of claim 29 wherein:

the plurality of first permanent magnets having first ends, the plurality of second permanent magnets having second ends, and the first ends and the second ends having the same polarity.

* * * * *